US005730073A

United States Patent [19]

Kobata

[11] Patent Number: 5,730,073

[45] Date of Patent: Mar. 24, 1998

[54] WASTE FLON DISPOSAL METHOD

[75] Inventor: Takeji Kobata, Sapporo, Japan

[73] Assignee: The Social Welfare Foundation Hokkaido Rehabily, Hokkaido, Japan

[21] Appl. No.: 801,941

[22] Filed: Feb. 14, 1997

[30] Foreign Application Priority Data

Oct. 4, 1996 [JP] Japan ..... 8-264415

[51] Int. Cl.[6] ..... F23G 15/00

[52] U.S. Cl. ..... 110/346; 110/229; 110/235; 110/255; 422/168; 422/169

[58] Field of Search ..... 110/255, 257, 110/346, 229, 235; 422/168, 169

[56] References Cited

U.S. PATENT DOCUMENTS 5,167,772 12/1992 Parker, Sr. ..... 202/105

5,505,909 4/1996 Dummersdorf et al. ..... 422/168

FOREIGN PATENT DOCUMENTS 127812 5/1989 Japan .

*Primary Examiner*—Henry A. Bennett
*Assistant Examiner*—Pamela A. O'Connor
*Attorney, Agent, or Firm*—Darby & Darby

[57] ABSTRACT

When scrap tires containing metal wire are incinerated in the scrap tire combustion furnace at a temperature of 400° to 950° C. in the presence of oxygen, $CO_2$ and water vapor is implemented, waste flons soaked into cloths, for example, are loaded together with scrap tires into the furnace. In this method, waste flons can be decomposed nearly 100%, under the reactions of hydrocarbons as well as a slight amount of sulfur which are both generated when the scrap tires burns.

12 Claims, 3 Drawing Sheets

WASTE FLON DISPOSAL METHOD

BACKGROUND OF THE INVENTION (1) Field of the Invention

The present invention relates to a waste flon disposal method, and in particular relates to a waste flon disposal method for implementing waste flon disposal together with the disposal of scrap tires by incineration.

(2) Description of the Prior Art

The formal name of flons is chlorofluorocarbons, and this indicates compounds made up of carbon, chlorine, fluorine. Various compounds are known. Those having a lower number of carbon atoms are non-toxic and stable thermally and chemically, noncorrosive to metals, and are colorless, odorless gases or liquids having a low boiling point. Because of these properties, flons have been used widely as aerosol propellants, cleansing agents for electronic parts, coolant for cooling machines such as refrigerators, air-conditioners as is well-known.

In recent years, there has been a big concern that used flons evaporate reaching the stratosphere, depleting the ozone layer, which in turn increases the amount of ultraviolet radiation reaching the Earth's surface. This causes diseases such as skin cancer, cataracts etc. on the one hand, and on the other hand, causes abnormal weather such as Earth's climate change, i.e., global warming, or adversely affects the ecosystem.

To deal with this problem, international conferences were held one after another in the 1980s, and the Montreal Protocol concerning the preservation of the ozone layer was adopted in 1987, and the Helsinki Declaration for abolishing flons totally within this century was adopted in May 1989. In Japan, an act on preservation of the ozone layer was legislated in May 1988.

Under such worldwide trends, also in Japan, the use of flons for aerosol products and the like has disappeared in recent years while alternate refrigerants in place of flons have been eagerly studied. On the other hand, concerning flons widely used as a coolant for conventionally existing refrigerators, air-conditions (including those for houses and cars, etc.), flons as the coolant need to be collected completely at the time those appliances are abandoned, and those thus collected should be decomposed by some means into harmless substances other than flons.

With recent rapid popularization of refrigerators, home-use air conditioners, car air conditioners, etc., there is a sharp increase in discarded used products accompanied by purchases of new models. For example, in the case of automobiles, the disposal of waste car bodies, scrap tires have previously attracted attention, in recent years, the disposal of flons used as a coolant for car air conditioners has become a big problem. The disposal of scrap tires already has been a social problem everywhere in the world from an earlier time. For this problem, the inventor has disclosed a series of proposals for the disposal of scrap tires including a technology patented as Japanese Pat. No.1,709,953, and has already established technologies for incinerating scrap tires and forming good activated carbon from cinders arising after the incineration.

On the other hand, for the disposal of flons, generally, flon as a refrigerant incorporated in the refrigerating machine in each of the aforementioned appliances to be abandoned, is once collected into a cylinder etc., and thereafter, the collected gas needs to be processed by an appropriate means. As stated above, since flons are generally stable thermally and chemically, it was assumed that flons cannot be decomposed by a regular method such as combustion or the like. One of the disposal methods for flons known at present is a decomposition process using plasma. This method is recognized as an effective method of decomposing flons, however, it is inevitable but somehow to increase the cost for the disposal.

As stated above, discarding of the appliances incorporating flon is expected to increase in the future accompanied by replacement from old models to new models, while the need for a prompt and reliable disposal method of collected flons expectantly increases with the worldwide trend in the full abolishment of flons. However, up to now, no means has been proposed which is relatively simple and can almost completely nullify the harm of flons.

SUMMARY OF THE INVENTION

It is therefore an object of the present invention to provide a waste flon disposal method which enables almost complete decomposition of waste flons in a very simple method, by adding some functional means to a existing practical plant, without affecting the operation of the existing plant and the functions thereof.

The present invention has been achieved in view of the above object, and the gist of the invention is as follows:

In accordance with a first aspect of the invention, a waste flon disposal method, wherein incineration of scrap tires containing metal wire at a temperature of 400° to 950° C. in the presence of oxygen, $CO_2$ and water vapor is implemented in parallel, includes the steps of:

introducing waste flon into the scrap tire combustion furnace by means of an arbitrary means; and burning the waste flon in the reactions with carbon, hydrogen, sulfur which are generated with the incineration of scrap tire to decompose the waste flon.

A second waste flon disposal method of the invention has the first feature and resides in that when waste flon is introduced into the scrap tire combustion furnace by means of an arbitrary means, the processing temperature of the scrap tires is set at 800° to 900° C.

A third waste flon disposal method of the invention has the first feature, and resides in that the introducing means for introducing waste flons into the combustion furnace is configured such that waste flon is injected into inflammable carrier medium and the carrier medium is loaded together with the scrap tires into the furnace.

A fourth waste flon disposal method of the invention has the second feature, and reside in that the introducing means for introducing waste flons into the combustion furnace is configured such that waste flon is injected into inflammable carrier medium and the carrier medium is loaded together with the scrap tires into the furnace.

A fifth waste flon disposal method of the invention has the first feature, and resides in that the introducing means for introducing waste flons into the combustion furnace comprises a spraying means which is exposed to the interior of the furnace from the surface of the internal wall thereof and directly injects flons into the furnace.

A sixth waste flon disposal method of the invention has the second feature, and resides in that the introducing means for introducing waste flons into the combustion furnace comprises a spraying means which is exposed to the interior of the furnace from the surface of the internal wall thereof and directly injects flons into the furnace.

A seventh waste flon disposal method of the invention has the third feature, and resides in that the injection of waste flons into the carrier medium is implemented 10 to 30 seconds before the scrap tires are loaded into the furnace.

An eighth waste flon disposal method of the invention has the fourth feature, and resides in that the injection of waste flons into the carrier medium is implemented 10 to 30 seconds before the scrap tires are loaded into the furnace.

Waste flon disposal methods in accordance with the ninth to twelfth features of the invention, have the respective third, fourth, sixth and seventh features, and are characterized in that the amount of the injected waste flon is 10 to 50 kg per 160 kg of the scrap tires.

Thus, the present invention is configured as above. Therefore, in accordance with the first aspect of the invention, it is possible to not only set up conditions which achieve high combustion efficiency as a scrap tire disposal method for the original purpose, still enable production of high-quality activated carbon from the cinder of the tires, but also to decompose flons by using reactions of flons with carbon, hydrogen and sulfur components, which are all generated during the incineration of the scrap tires. As a result, it is possible to implement flon disposal in a very simple manner without affecting the effects of scrap tire disposal of the original aim.

In accordance with the second aspect of the invention, since the processing temperature of flons in the combustion atmosphere can be optimized by setting the processing temperature of scrap tires at 800° to 900° C., it is possible to further stabilize the decomposing process of flons.

In accordance with the third and fourth aspects of the invention, the introducing means for introducing waste flons into the combustion furnace is to pack an inflammable carrier medium, e.g., scrap cloth etc., into space of tires such as tube space and inject waste flons into the medium. Thus, it is possible to introduce an arbitrary amount of waste flons together with scrap tires into the furnace in a very simple manner.

In accordance with the fifth and sixth aspects of the invention, since the introducing means for introducing waste flons into the combustion furnace comprises a spraying means which is exposed to the interior of the furnace from the surface of the internal wall thereof and directly injects flons into the furnace, it is possible to introduce an arbitrary amount of flons under control of the loading amount of flons in accordance with the loading interval of scrap tires. As a result, it is possible to implement disposal of waste flons efficiently in a simple handling because no carrier medium is needed.

Further, in accordance with the seventh and eighth aspects of the invention, since the injection of waste flons into the carrier medium is implemented 10 to 30 seconds before the scrap tires filled with the carrier medium are loaded into the furnace, it is possible to prevent the escape of flons. Further, from the experiment, this condition was found to optimize the decomposing efficiency of flons.

Finally, in accordance with the ninth through twelfth aspects of the invention, since the amount of the injected waste flon is 10 to 50 kg per 160 kg of the scrap tires, an optimized decomposing efficiency of flons can be established, thus making it possible to obtain decomposing efficiency nearly equal to 100%.

DESCRIPTION OF THE PREFERRED EMBODIMENTS

The embodiment of the present invention will hereinafter be described in detail with reference to the accompanying drawings.

Figure 1:
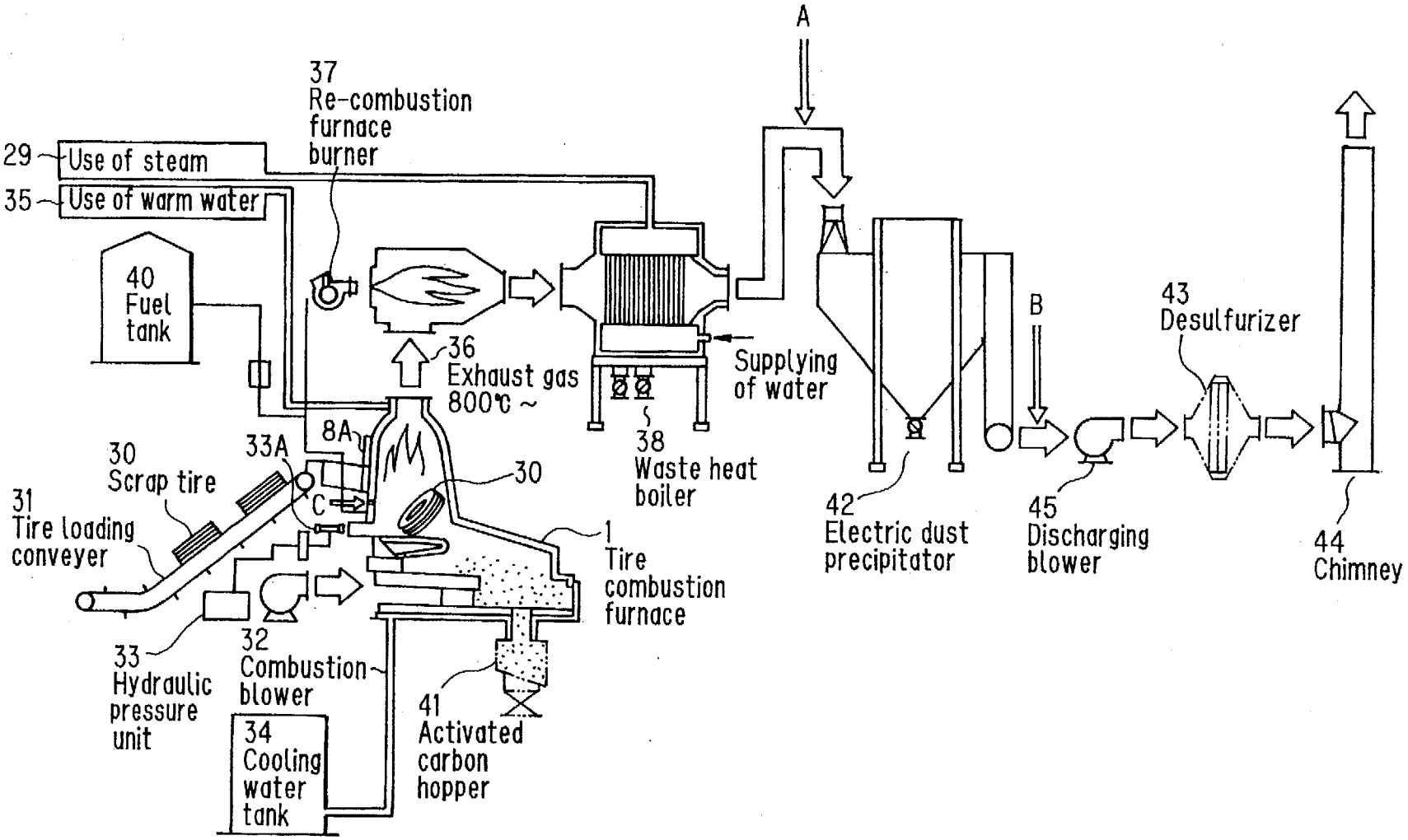
FIG. 1 is an overall illustrative view showing an example of a scrap tire disposal plant which is used for the invention.

First, an overall configuration of the installation in which the disposal method of the invention is implemented will be described with reference to the drawings. FIG. 1 shows an overall illustrative view showing an example of a scrap tire disposal plant which is used for the invention. In this figure, 1 designates a tire combustion furnace for incinerating scrap tires. Scrap tires 30 are conveyed by a tire loading conveyer 31 to be loaded into tire combustion furnace 1 through a tire loading port 8A. The thus loaded tires 30 are forced to burn by sending air from a combustion blower 32 through many air nozzles (not shown) provided in the water-cooled furnace walls. Designated at 33 is a hydraulic pressure unit for operating a presser 33A to successively push out the cinders of tires; 34 designates a cooling water tank.

The aforementioned tire loading conveyer 31, as described hereinbelow, is the first introducing means of waste flon into the furnace. An appropriate spraying means which is exposed to the interior of the furnace from the surface of the internal wall of it may be formed at the position, indicated by arrow C, on the furnace wall near tire loading port 8A, thus providing another configuration for the introducing means for waste flons into the furnace.

Water is made warm by incinerating scrap tires in the furnace having the above configuration; the warm water thus produced by the generated heat from the incineration is used (35). Exhaust gas 36 from the combustion includes inflammable gases, which are added with fuel so as to be burned in a re-combustion furnace burner 37 up to 800° to 900° C. under a constant pressure. Then, steam is produced through water-tube waste heat boiler 38 to be used for some applications (39). Here, designated at 40 is a fuel tank.

Since the cinders of scrap tires 30 thus burned are used to produce good activated carbon, they are collected into an activated carbon hopper 41 where they are screened and classified as necessary to be made into activated carbon products. The exhaust having passed through waste heat boiler 38 passes through an electric dust precipitator 42, desulfurizer 43 using the activated carbon and is discharged through a chimney 44. Here, designated at 45 is a discharging blower. Points A and B before and after electric dust precipitator 42, designate the positions where a neutralizing means for gases generated due to the decomposition of waste flon should be placed. As will be shown hereinbelow, if electric dust precipitator 42 is of a wet type, the means is most effectively placed at position A and if it is of a dry type, the means is placed at B.

In the above configuration of the invention, since air is ejected into the combustion chamber from blast pipes through the duct and air jacket, as will be described, i.e., the chamber is of an air curtain type, flames due to combustion are directed towards the center of the combustion chamber without directly striking the right and left walls. Thus, these walls can be protected. The water chamber formed around the side walls of the combustion chamber is provided with blast tubes, which also have a reinforcing function, enabling prevention of deformation of the side walls of the combustion chamber due to heat radiation.

Figure 2:
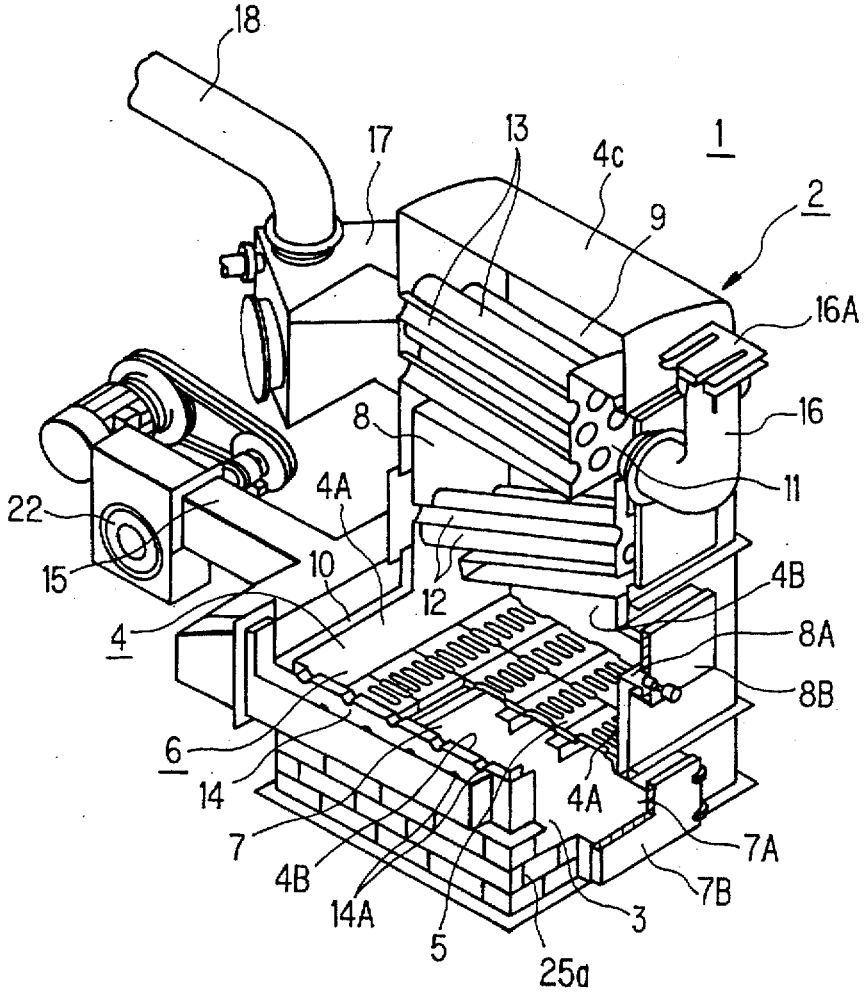
FIG. 2 is a partial cutaway perspective view showing in detail the internal structure of another example of a scrap combustion furnace which is applied to the invention.

FIG. 2 is another example of the scrap tire combustion furnace which is applied to the invention, and is a partial cutaway perspective view showing in detail the internal structure of the combustion chamber of an air curtain type. Now, the description will be made with reference to the figure. In the figure, 1 designates scrap tire incinerating furnace.

A reference numeral 2 designates a furnace body, 3 a hearth, and 4 a furnace housing disposed above hearth 3 consisting of front and rear walls 4A, right and left walls 4B and a top plate 4C.

This housing 4 is divided into two rooms, i.e., an upper room 6 and an cinder collecting room 7 with a grating 5 in between extending across a plane spaced a predetermined height from hearth 3. Here, walls 25*a* of the cinder collecting room 7 are formed by laid bricks.

Upper room 6 is constructed with a combustion chamber 8 disposed at the lower portion thereof and an upper water chamber 9. Formed on the periphery of the side walls of combustion chamber 8 is a lower water chamber 10 that communicates with upper water chamber 9.

A reference numeral 8A designates a tire loading port opening on the front side of combustion chamber 8. A lid 8B that can be opened and closed is provided for tire loading port 8A.

Designated at 7A is an cinder removal port opening on the front side of cinder collecting room 7. A lid 7B that can be opened and closed is provided for cinder removal port 7A.

An upper combustion chamber designated at 11 is formed in front of upper water chamber 9 and communicates with combustion chamber 8.

Designated at 12 is an appropriate number of water tubes which are disposed obliquely inside combustion chamber 8. The front ends are connected with the front portion of lower water chamber 10. The rear ends of the tubes, lower than the front ends, are connected with the rear portion of lower water chamber 10. Accordingly, waste heat including flames and heat in combustion chamber 8 are exhausted while heating water tubes 12.

An appropriate number of furnace tubes designated at 13 are disposed inside upper water chamber 9. The front ends communicate with upper combustion chamber 11 while the other ends open on rear wall 4A.

A reference numeral 14 designates an air jacket, which is attached onto right and left side walls 4B of housing 4 in positions corresponding to combustion chamber 8. Air jacket 14 is made to communicate with combustion chamber 8 through lower water chamber 10 by an appropriate number of blast tubes 14A.

Designated at 15 is a duct that communicates with air jacket 14. A blower 22 is jointed to duct 15. Air supplied to combustion chamber 8 is drawn by blower 22, and blown into combustion chamber 8 through duct 15 and air jacket 14.

An exhaust pipe designated at 16 is provided in the upper portion of front wall 4A of housing 4 and communicates with upper combustion chamber 11. An explosion-proof lid 16A is provided on exhaust pipe 16.

A reference numeral 17 designates an exhaust chamber, which is attached in the upper portion of rear wall 4A of housing 4 enclosing the rear end openings of furnace tubes 13. Exhaust chamber 17 is jointed to an exhaust gas tube 18.

Next, the implementing means for waste flon disposal method of the invention using the thus configured plant will be described.

Scrap tires from automobiles, which in recent years have been increasing as industrial waste, are used as mentioned before, as the basic combustion supporting material for waste flon disposal. Such scrap tires generally contain metal wire such as steel wire, etc. The metal component can be oxidized and dispersed as the rubber component of scrap tires burns, under appropriate control of the combustion atmosphere. These tires are burned in the furnace at 400° C. to 950° C., preferably, 800° C. to 900° C. under the presence of oxygen, carbon dioxide and vapor.

In this case, air for combustion preferably contains a high-level of moisture, or is for example, at a relative humidity of at least 60%, and it is preferable that water is added to the combustion atmosphere by an appropriate means, as required.

Flons are generally nonflammable, but it is known that a mixture of flons and hydrocarbons burn at temperatures of about 900° C. A hydrocarbon atmosphere is generated in the combustion furnace of the scrap tires as the tires are decomposed. Therefore, if flon is introduced into the furnace by an arbitrary means, it is possible to burn the flon.

Generally, tires are composed of natural and synthetic rubber compounds which consist in most part of bonded carbon and hydrogen atoms, carbon components primarily consisting of carbon black, metal wire such as steel wire etc., and further contain a little amount of sulfur which is added as a vulcanizing chemical in rubber compounds. For unknown reasons, the present inventor has confirmed that the presence of a small amount of sulfur components in the furnace combustion atmosphere has good effects on the decomposition efficiency of flons.

As an example of the introducing means for waste flons into the furnace, an appropriate spraying means which is exposed to the interior of the furnace from the surface of the internal wall of it may be provided, as a direct introducing means, at the position indicated by arrow C in FIG. 1, so that waste flons will be directly ejected into the combustion atmosphere and burned therein. Alternatively, the present invention proposes the following configuration which enables a very simple introducing method of flons into the tire combustion furnace without any practical modification of the conventional plant.

Before the loading of scrap tires 30, which are conveyed by tire loading conveyer 31 already shown in FIG. 1, into combustion furnace 1 through tire loading port 8A, hollows in the scrap tires 30, e.g., tube spaces, are filled up with an inflammable carrier medium such as rags or a scrap of cloth or something having analogous properties. Right before the stuffed scrap tires 30 are loaded into loading port 8A, as being conveyed by conveyer 31, the carrier medium is made to carry waste flons so that the flons can be loaded into combustion furnace 1 together with scrap tires 30.

In most cases, waste flon collected was filled into cylinders and stored therein. Therefore, when it is released, an appropriate tube or the like may be used to connect to the cylinder so that the flon can be directly injected into the carrier medium such as a scrap of cloth etc. by opening the valve. The thus discharged waste flon will soak into the medium or will solidify like dry ice, although this depends on the composition (boiling point) of the flon. Therefore, escaping amount of flons into the air can be minimized. The addition of waste flons to scrap tire 30 is carried out 10 to 30 seconds before loading scrap tire 30 into combustion furnace 1, in order to prevent the escape of flons. Further, for unknown reasons, it was empirically found that in this condition, the efficiency of decomposition of flons was maximized.

Figure 3:
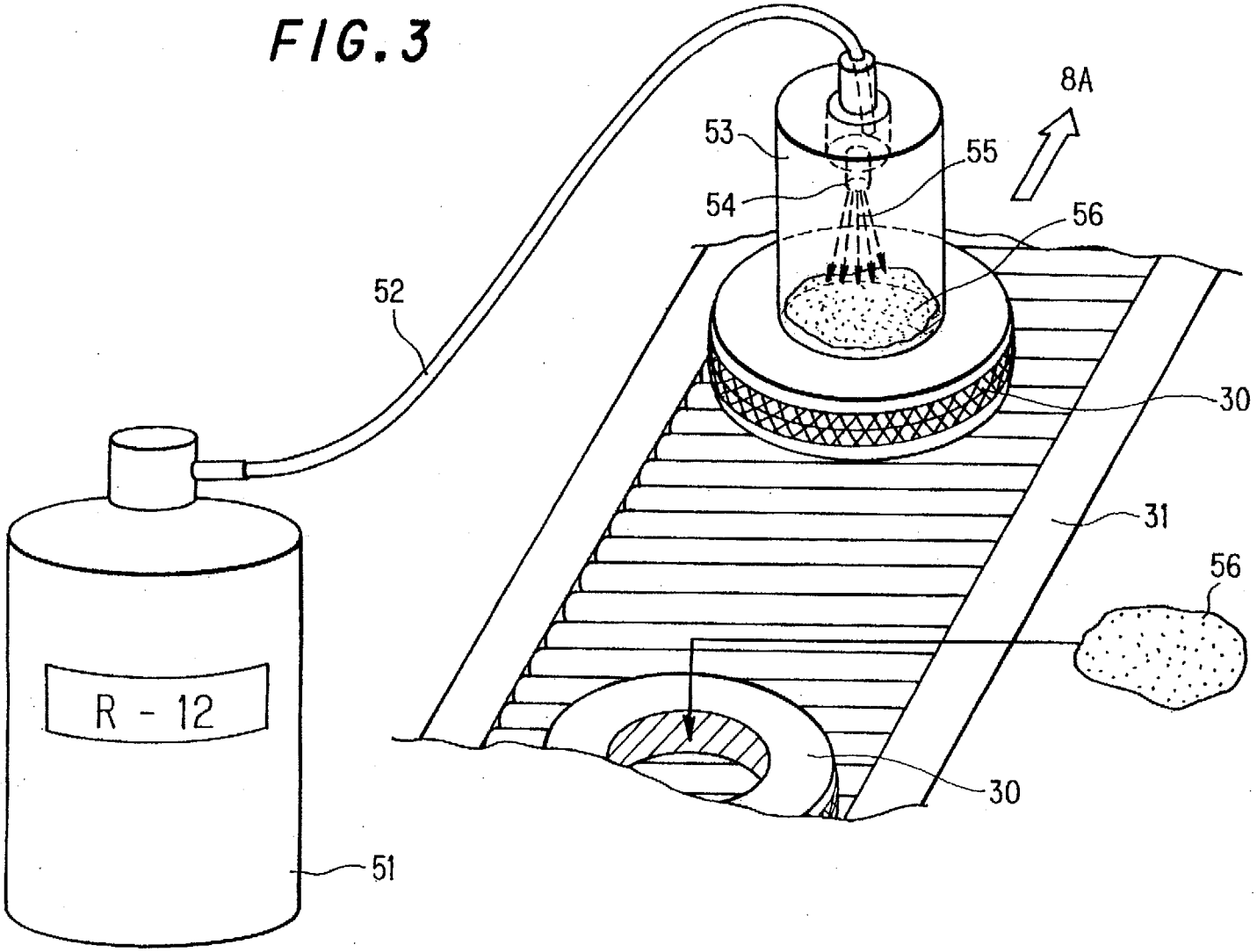
FIG. 3 is a perspective view showing an illustrative form of a means for adjoining waste flons to scrap tires in accordance with the invention.

FIG. 3 is a perspective view showing an illustrative form of a means for adjoining waste flons to scrap tires in accordance with the invention, where a flon blast enclosure is used.

In FIG. 3, 31 is a tire loading conveyer, which as shown in FIG. 1, conveys scrap tires 30 toward tire loading port 8A (in the direction shown by the arrow). During conveyance, a carrier medium for flons, e.g., scrap cloth 56, etc., is packed beforehand into scrap tire 30 as shown by the arrow, as stated before. Subsequently, right before tire 30 is loaded through loading port 8A, scrap cloth 56 is covered with blast enclosure 53 and at the same time waste flon gas 55 which is stored in flon cylinder 51 and is delivered through a hose 52, is ejected from a nozzle pipe 54 provided in blast enclosure 53. In this configuration, waste flon solidifies like dry ice, as stated above, to be integrated with scrap cloth 56, and thus the scrap tire 30 with solid flon is fed into loading port 8A. In this case, blast enclosure 53 may be made of any material operation, used sheets (cotton cloth) were stuffed into the tube space of the tires, and a 10 to 50 kg flon was injected for each 160 kg of the tires 10 to 30 seconds before they were loaded into the combustion furnace, using the means shown in FIG. 3, and these were loaded. As a flon, CFC-12 (boiling point -29.8° C.) was used. This flon was one extracted from car air conditioners of scrapped cars. The flon solidified like a dry ice almost as soon as it was injected into the tires. The temperature of the combustion chamber was 900° C. As a neutralizing means, a soda ash solution bath was installed after (position B) the dry type electric dust precipitator.

As a result of repeated experiments in the above cycle, the descending amount of temperature was about 6° C. after one loading of tires. Since this instantly restored back to the original furnace temperature, no hindrance occurred in the combustion chamber. In this case, of the aforementioned conditions, the operation was especially excellent when a 20 to 30 kg flon per 160 kg of tires was added about 20 seconds before the loading into the combustion furnace, achieving flon decomposition efficiency of 99.78 to 99.99%. Further, the material characteristics and the yield of the obtained activated carbon were quite comparable to those obtained in a normal process using the plant shown in FIG. 1 and FIG. 2. Further, neither HF nor HCL was practically in the form of a bell-like shape. Using this mode of the embodiment, the addition of flon can be implemented more reliably, further decreasing the risk of flon escaping into the air. It is also possible to reduce the risk of being frostbitten during the ejection of waste flon.

The above disposal process of waste flons resultantly generates an exhaust gas with HF and HCL. This can be neutralized using an alkali solution, e.g., a solution of soda ash, in a similar technique as performed in the wet desulfurizing means. The neutralizing means can be placed, after electric duct precipitator 42, i.e., at the position B if the dust precipitator is of a dry type, or alternatively, it can be positioned before the duct precipitator, i.e., at the position A if the precipitator if of wet type. Since other gases, such as $SO_2$, NOx, $CO_2$, HCL, etc., can be adsorbed through desulfurizing means 43, only pollution-free exhaust is discharged from chimney 44. The aforementioned HF and HCL can be separated as fluorite, sodium chloride as a result of the neutralizing process, so that they can be removed as non-toxic substances.

Referring now to the result of an experiment, using an existing scrap tire combustion furnace, with the warm water, steam and other factors kept as specified, scrap tires, each being about 35 kg in weight, were incinerated at intervals of 6 minutes as being loaded 160 kg in total. In this detected from the exhaust discharged from the chimney.

As has been described in accordance with waste flon disposal method of the invention, since flons are introduced into the scrap tire combustion furnace being operated in appropriate operating condition, and are decomposed during combustion under the presence of carbon, hydrogen and sulfur components, the system is not limited to the embodiments shown in FIG. 1 and FIG. 2. Further, the introducing means of waste flons into the combustion furnace is not limited to the system by which flon is adjoined to the scrap tire as in the above embodiment. Needless to say, a direct ejecting means can be used to load waste flons into the combustion chamber.

Additionally, as to the adjoining method using a carrier medium, the carrier medium is not limited to the cloths exemplified above. Any material can be used as the carrier medium as long as it shows the same effects. Moreover, concerning flons to be processed, it goes without saying that flons other than CFC-12 exemplified above, are applicable to this invention. The installations shown in FIGS. 1 and 2 are used for the plant for producing high-quality activated carbon together while effecting the scrap tire disposal However, taking into account the increase in the accumulated quantity of waste flons in recent years, these plants can, of course, be used dedicatedly for waste flon disposal.

As has been apparent from the above description, in accordance with the invention, it is possible to decompose waste flons almost completely in a very simple method, by adding some functional means to an existing practical plant. Further, since the operation of the existing plant as well as the effects thereof will not be affected at all, the present invention can be expected to be used from now on, as a means capable of reliably implementing the disposal of waste flons which attracts an international concern as the industrial waste threatening the global environment, in a pollution-free manner.

What is claimed is:

1. A waste flon disposal method, wherein incineration of scrap tires containing metal wire at a temperature of 400° to 950° C. in the presence of oxygen, $CO_2$ and water vapor is implemented in parallel, comprising the steps of:

introducing waste flon into a scrap tire combustion furnace by means of an arbitrary means; and burning the waste flon in the reactions with carbon, hydrogen, and sulfur which are generated with the incineration of scrap tire to decompose the waste flon.

2. A waste flon disposal method according to claim 1, wherein when waste flon is introduced into the scrap tire combustion furnace by means of an arbitrary means, the processing temperature of the scrap tires is set at 800° to 900° C.

3. A waste flon disposal method according to claim 2, wherein the introducing means for introducing waste flon into the combustion furnace is configured such that waste flon is injected into inflammable carrier medium and the carrier medium is loaded together with the scrap tires into the furnace.

4. A waste flon disposal method according to claim 3, wherein the injection of waste flon into the carrier medium is implemented 10 to 30 seconds before the scrap tires are loaded into the furnace.

5. A waste flon disposal method according to claim 3, wherein the amount of the injected waste flon is 10 to 50 kg per 160 kg of the scrap tires.

6. A waste flon disposal method according to claim 2, wherein the introducing means for introducing waste flon into the combustion furnace comprises a spraying means which is exposed to the interior of the furnace from the surface of the internal wall thereof and directly injects flon into the furnace.

7. A waste flon disposal method according to claim 6, wherein the amount of the injected waste flon is 10 to 50 kg per 160 kg of the scrap tires.

8. A waste flon disposal method according to claim 1, wherein the introducing means for introducing waste flon into the combustion furnace is configured such that waste flon is injected into an inflammable carrier medium and the carrier medium is loaded together with the scrap tires into the furnace.

9. A waste flon disposal method according to claim 8, wherein the injection of waste flon into the carrier medium is implemented 10 to 30 seconds before the scrap tires are loaded into the furnace.

10. A waste flon disposal method according to claim 9, wherein the amount of the injected waste flon is 10 to 50 kg per 160 kg of the scrap tires.

11. A waste flon disposal method according to claim 8, wherein the amount of the injected waste flon is 10 to 50 kg per 160 kg of the scrap tires.

12. A waste flon disposal method according to claim 1, wherein the introducing means for introducing waste flon into the combustion furnace comprises a spraying means which is exposed to the interior of the furnace from the surface of the internal wall thereof and directly injects flon into the furnace.

* * * * *